US008720896B2

(12) United States Patent
Matthis

(10) Patent No.: US 8,720,896 B2
(45) Date of Patent: May 13, 2014

(54) PORTABLE ARCHERY TARGET SUPPORT

(76) Inventor: Bradley S. Matthis, Oregon City, OR (US)

( * ) Notice: Subject to any disclaimer, the term of this patent is extended or adjusted under 35 U.S.C. 154(b) by 194 days.

(21) Appl. No.: 13/427,103

(22) Filed: Mar. 22, 2012

(65) Prior Publication Data

US 2013/0147119 A1 Jun. 13, 2013

Related U.S. Application Data

(63) Continuation-in-part of application No. 13/324,913, filed on Dec. 13, 2011.

(51) Int. Cl.
*F41J 1/10* (2006.01)
*F16M 11/00* (2006.01)

(52) U.S. Cl.
USPC ..... 273/407; 273/408; 248/163.2; 248/431

(58) Field of Classification Search
USPC ..... 273/403–410; 248/163.1, 163.2, 248/164–173, 188, 188.7, 431, 432, 440.1
See application file for complete search history.

(56) References Cited

U.S. PATENT DOCUMENTS

| | | | | | |
|---|---|---|---|---|---|
| 215,033 | A * | 5/1879 | Wright et al. | 273/407 |
| 2,670,918 | A * | 3/1954 | Kinnard | 248/188.5 |
| 2,899,204 | A * | 8/1959 | Rattay | 273/392 |
| 4,609,174 | A * | 9/1986 | Nakatani | 248/465 |
| 4,625,974 | A * | 12/1986 | Andrews | 273/407 |
| 5,029,795 | A * | 7/1991 | Dexter | 248/431 |
| 5,150,768 | A * | 9/1992 | Olson et al. | 182/234 |
| 5,337,996 | A * | 8/1994 | Kalish | 248/460 |
| 5,383,634 | A * | 1/1995 | Liao | 248/166 |
| 7,063,006 | B1 * | 6/2006 | Spehle et al. | 99/340 |
| 7,338,048 | B1 * | 3/2008 | Hulstine et al. | 273/407 |
| 2003/0173477 | A1 * | 9/2003 | FitzSimons | 248/166 |
| 2010/0127227 | A1 * | 5/2010 | Dunlap | 254/266 |
| 2012/0074290 | A1 * | 3/2012 | Nakatani | 248/440.1 |
| 2012/0298829 | A1 * | 11/2012 | Johnson et al. | 248/440.1 |

* cited by examiner

*Primary Examiner* — Mark Graham
(74) *Attorney, Agent, or Firm* — Peter A Haas Esquire LLC

(57) ABSTRACT

In a preferred embodiment the present invention contemplates a system for selectively coupling a shooting target to a target mount device. This system includes a target mount device having a T-shaped mount body. The mount body has three mount holes defined on an underside of the mount body and each mount hole terminates at a solid wall portion provided by an underside of a top surface of the mount body. Three legs selectively attach to the mount body, one leg at each corresponding mount hole. At least one leg includes an adjustment mechanism for extending the length of the leg. A conventional target attaches to the mount device by a mechanism for suspending the target from the mount block coupled to the mount block.

5 Claims, 7 Drawing Sheets

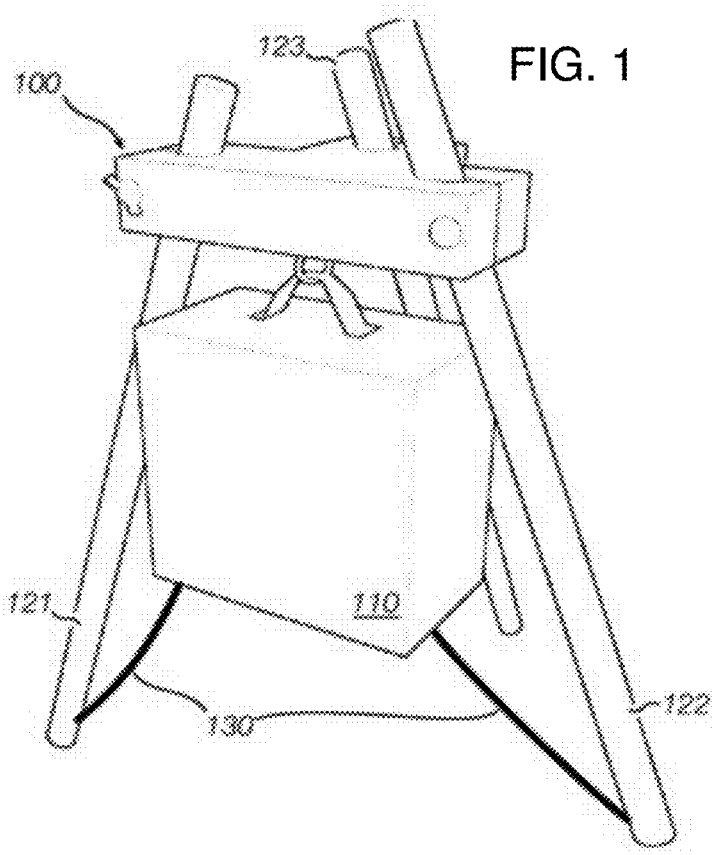
FIG. 1
FIG. 2
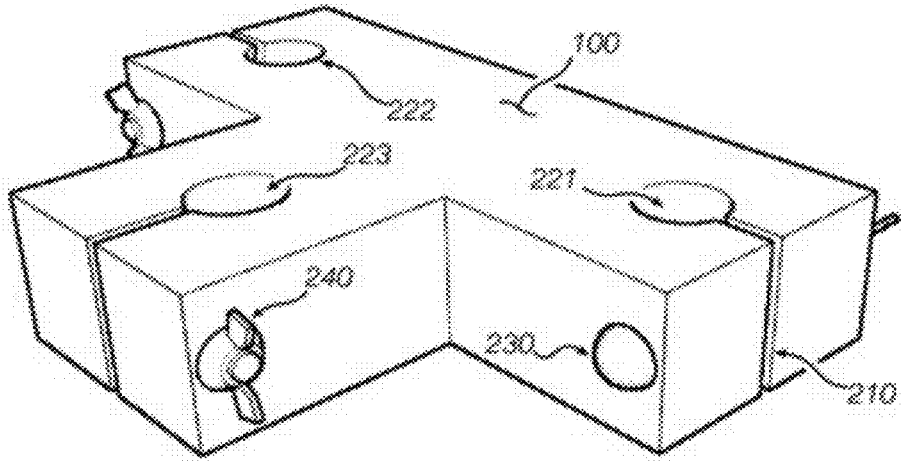

FIG. 3
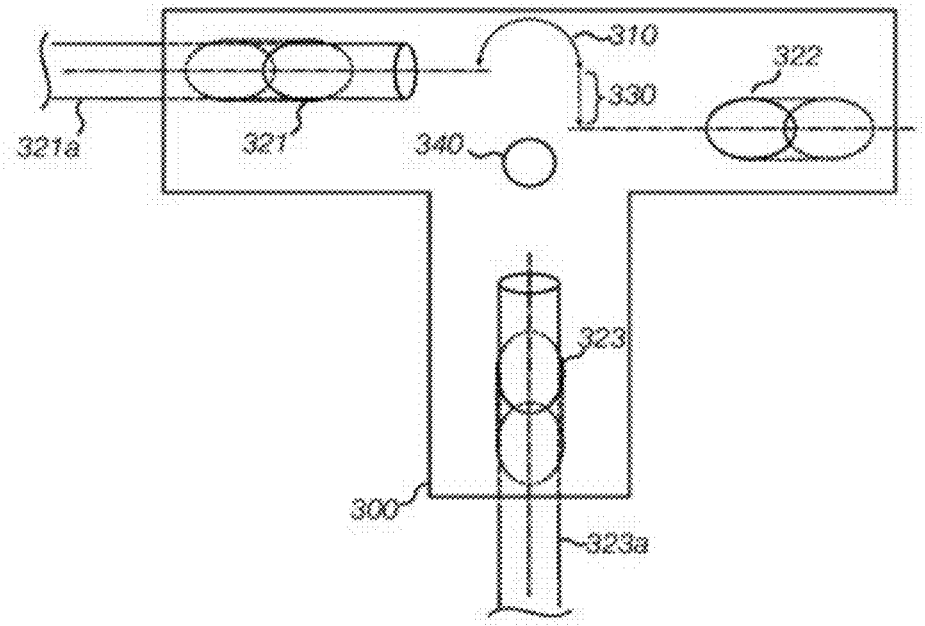
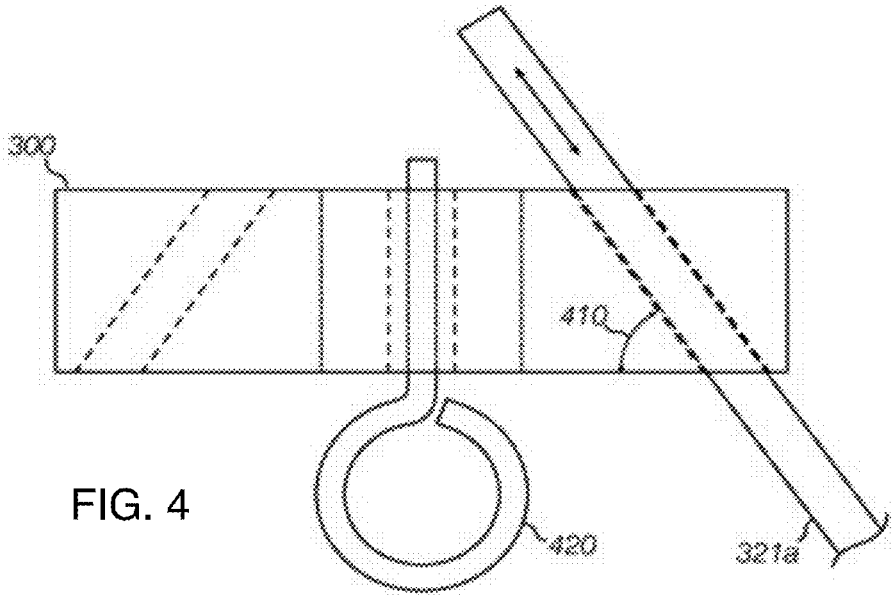
FIG. 4

PORTABLE ARCHERY TARGET SUPPORT

PRIORITY CLAIM

The present application is a Continuation in Part and claims benefit under 35 USC Section 120 of U.S. Utility patent application Ser. No. 13/324,913 filed on 2011 Dec. 13. The present application is based on and claims priority from this application, the disclosure of which is hereby expressly incorporated herein by reference.

BACKGROUND

The invention relates to archery and archery targets. More specifically, the invention relates to sturdy, portable support structures for use with archery targets.

Development of archery skills involves practice, often involving shooting at a commercially available target. Common target materials include: foam, newspaper, fused polyurethane, and polyethylene. Targets are built to absorb repeated shots (often on two, four, or even six sides) and allow for easy removal to avoid damage to arrow tips. Most targets are square or rectangular in shape and weigh between 15 and 25 pounds, include a top handle for easy carrying, and are covered by an all-weather poly material. Common sizes include: 24-inch×12-inch×24-inch, 18-inch×14-inch×18-inch and 18-inch×16-inch×11-inch.

Target stands provide stability to the target during shooting. However, most commercially available stands are not suitable for holding a target on uneven terrain, like a forest floor. Additionally, most are not lightweight and cannot be disassembled for ease of transport if the shooter decides to practice in a different location.

Therefore, a sturdy, adjustable and lightweight archery target stand that can be disassembled and adjusted with only primitive tools, or no tools, will be useful for shooters who wish to practice shooting in a remote location with uneven terrain. A stand comprised of components that are readily available allows for ease of repairs and adjustment.

SUMMARY OF THE INVENTION

Accordingly, the present invention contemplates a sturdy, adjustable, and lightweight archery target stand that can be disassembled and adjusted with only common hand tools, or preferably, no tools. And such a stand is constructed of components that are readily available, which allows for ease of repairs and adjustment.

Certain preferred embodiments of the invention include variations on securing the removable stand legs to the target mounting block ("mount"), which include: split flange, tapered insert, finger joint insert, finger jointed or spiral groove support leg, high-friction finish on the support leg, hose clamp securing mechanism, set screw securing mechanism, and a two-piece mount that tightens against the legs. An additional embodiment allows for multiple leg angles and leg positions to accommodate uneven terrain and allow optimal access to target without blocking the path of the arrow to the suspended target by one of the legs.

One preferred embodiment of the present invention includes a portable archery target. This portable archery target support comprises:

A T-shaped support block formed of a tough, resilient polymer material, said support block having three cylindrical holes formed near each terminal end of its shape, axes of said cylindrical holes approaching one another above a plane of the support block and diverging from one another below the plane of the support block;

A plurality of split flange slots to connect a cylindrical hole with an exterior edge of the support block, said slots substantially perpendicular to the plane of the support block;

At least one pinch bolt at each slot to compress the slot and constrict a corresponding cylindrical hole;

At least three cylindrical support legs to pass through the three cylindrical holes, said support legs sized so that they cannot pass easily through the cylindrical hole when the corresponding split flange is tightened; and A target support loosely connected to the support block between the cylindrical holes, said target support for suspending an archery target between the cylindrical support legs below the plane of the support block; and stabilizing shock cords to connect two bottom corners of the archery target to lower ends of two cylindrical support legs, said shock cords to deter the archery target from swinging and rotating excessively after an arrow strikes the target.

One contemplated modification to this embodiment includes a target wherein the support block is made from high-density polyethylene. The support block is approximately one and one-half inches (38 mm) thick. And wherein a crossbar of the T shape is approximately 4 inches (100 mm) long, and an upright of the T shape is approximately 6 inches (150 mm) long. Further, the axes of the cylindrical holes splay at approximately 45-degrees from a normal to the plane of the support block. Also, the target has cylindrical legs having a diameter of between approximately ⅜ inch (9.5 mm) and approximately 1⅛ inch (28.6 mm).

In one contemplated alternative embodiment, the target includes three cylindrical legs constructed from wooden dowels. In another embodiment, the three cylindrical legs are fabricated from aluminum tubes.

One contemplated target support includes an eyebolt secured to an oversized hole in the support block.

In another embodiment, a portable archery target support comprises:

A support block having at least three substantially cylindrical holes, at least two of which pass completely through the support block, axes of said cylindrical holes angled so that the axes approach one another above the support block and diverge from one another below the support block;

A target connection feature attached loosely to the support block and positioned to suspend a target between the axes of the cylindrical holes below the support block; and A support clamping means in each of the at least two through holes, said support clamping means to secure support legs inserted through the at least two through holes.

These aforementioned at least three cylindrical holes pass completely through the target support.

The portable archery target support also includes each support clamping means consisting of a slot in the support block extending from a side of a corresponding cylindrical hole to an outer surface of the support block, said slot oriented to be substantially co-planar with the axis of the corresponding cylindrical hole; and a threaded tensioning mechanism oriented substantially orthogonal to the slot, said threaded tensioning mechanism operative to pinch a material of the support block together at the slot and reduce a diameter of the corresponding cylindrical hole.

In one embodiment, the clamping means comprises a slight taper to each corresponding cylindrical hole so that a cylindrical support leg inserted through the tapered cylindrical hole slides easily from top to bottom, but does not slide easily from bottom to top.

In another embodiment, each support clamping means comprises a finger joint formed in a material of the support block, to provide friction based clamping of a support leg inserted therethrough.

In yet another embodiment, each support clamping means comprises a finger joint or spiral grooved finish of the support legs, to provide friction-based clamping of said support leg inserted therethrough.

In yet another embodiment, each support clamping means comprises a friction finish of the support legs, to provide friction-based clamping of said support leg inserted therethrough.

In yet another embodiment, each support clamping means comprises a set screw that protrudes into said through holes to restrict movement of said support legs.

In yet another embodiment, each support clamping means comprises hose clamps applied to said support legs at locations above a plane of the support block and below the plane of the support block.

In another preferred embodiment, the portable archery target support include a support block consisting of a first support block and a second support block having a peripheral outline similar to the first support block, and positioned in contact along a common surface with the first support block, the at least three cylindrical holes passing completely through the second support block, wherein the support clamping means is to offset the second support block from a first predetermined position with respect to the first support block, to a second predetermined position with respect to the first support block, so that cylindrical support legs extending through the first and second support blocks cannot slide easily therethrough.

DRAWING

FIG. 1 shows many common features of an embodiment.

FIG. 2 shows the split flange method of securing a leg to a T-shaped mount.

FIG. 3 details the angled and offset holes for securing a leg and location in a T-shaped mount.

FIG. 4 provides an additional view of the angled holes and shows the method of attachment for the target to the mount.

Figure 5:
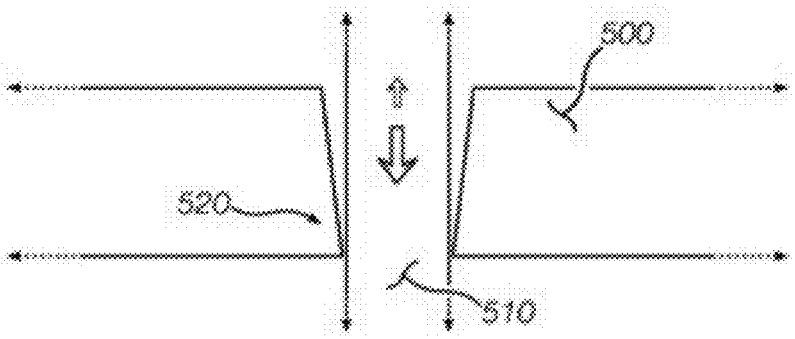

FIG. 5 details the leg hole and method of securing using a tapered insert.

Figure 6:
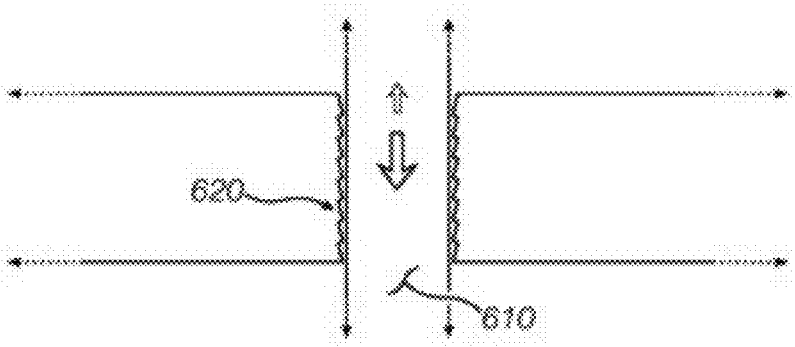

FIG. 6 details the leg hole and method of securing utilizing a finger joint finish in the mount.

Figure 7:
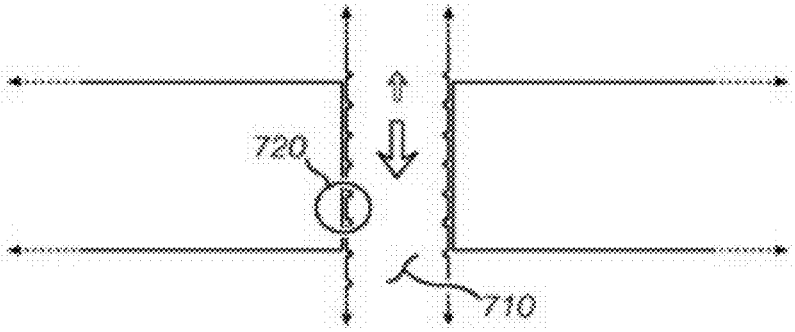

FIG. 7 details the leg hole and method of securing using a finger jointed or spiral grooved finish on the support leg.

Figure 8:
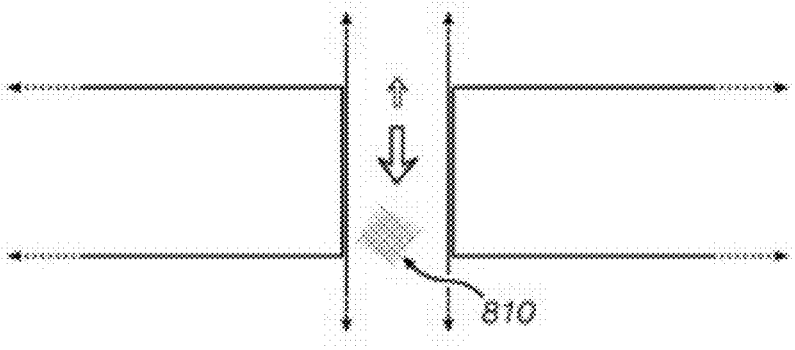

FIG. 8 details the leg hole and method of securing where a high friction finish is applied to the support leg.

Figure 9:
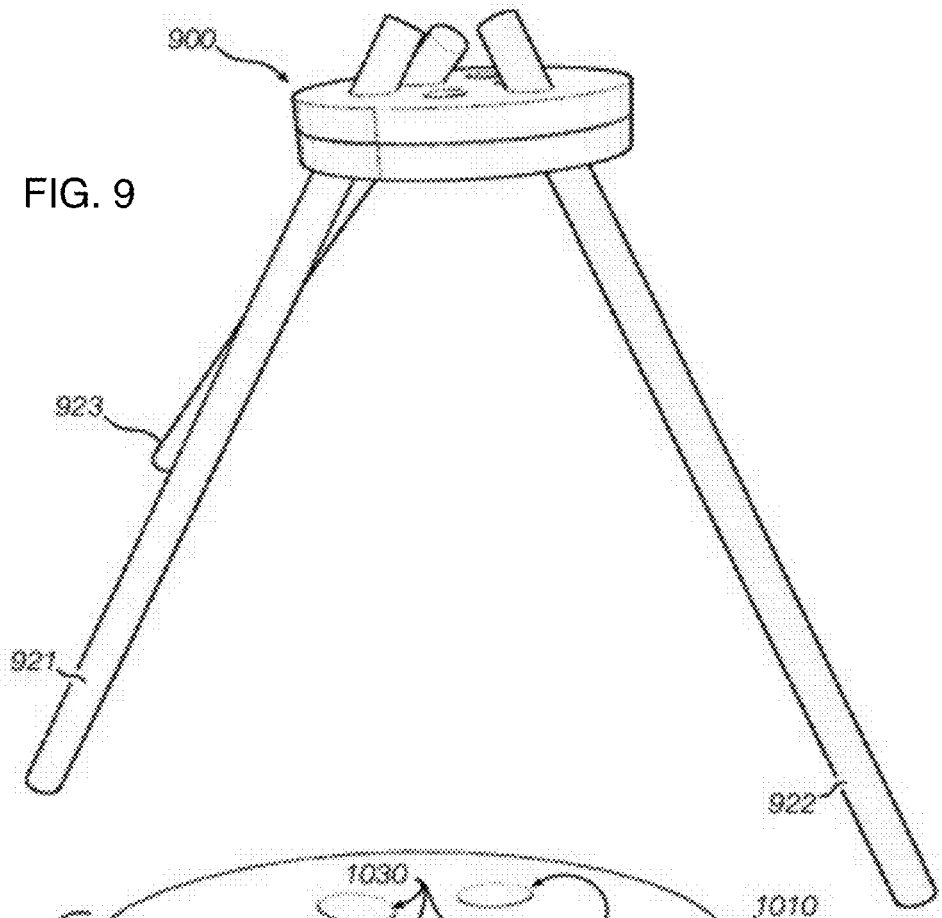

FIG. 9 shows a two-piece mount assembly that secures the legs by turning one of the pieces to tighten against the legs, acting as a sort of chock against the leg. A through bolt that compresses the mounts together provides a means of securing.

Figure 10:
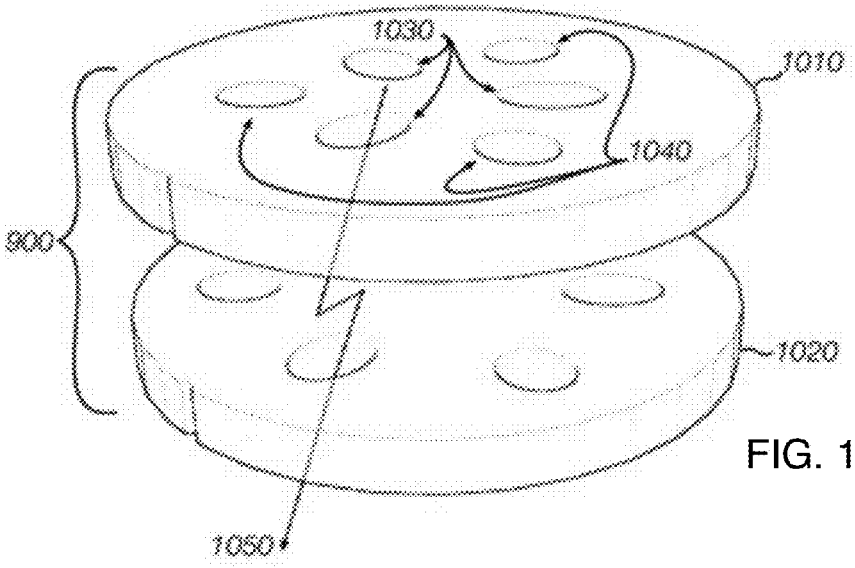

FIG. 10 provides a detail of the two-piece mount showing multiple leg locations and angles to accommodate uneven terrain and allow optimal access to target without interference from the legs.

Figure 11:
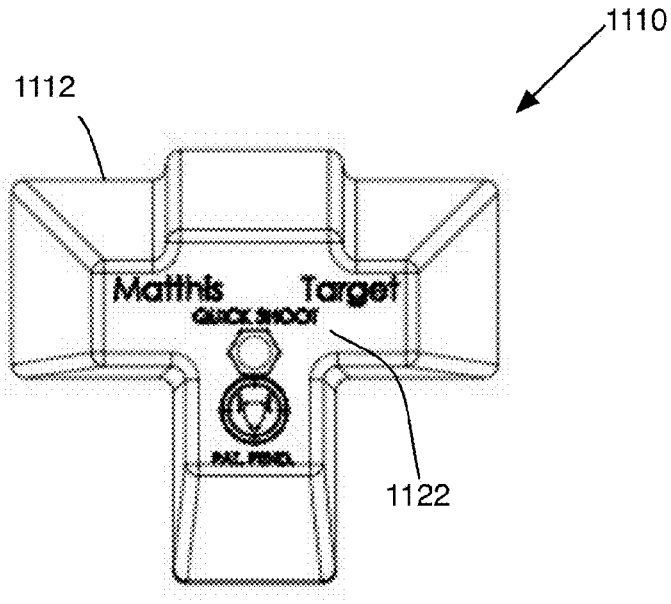

FIG. 11 is a top view of a second preferred embodiment according to the present invention.

Figure 12:
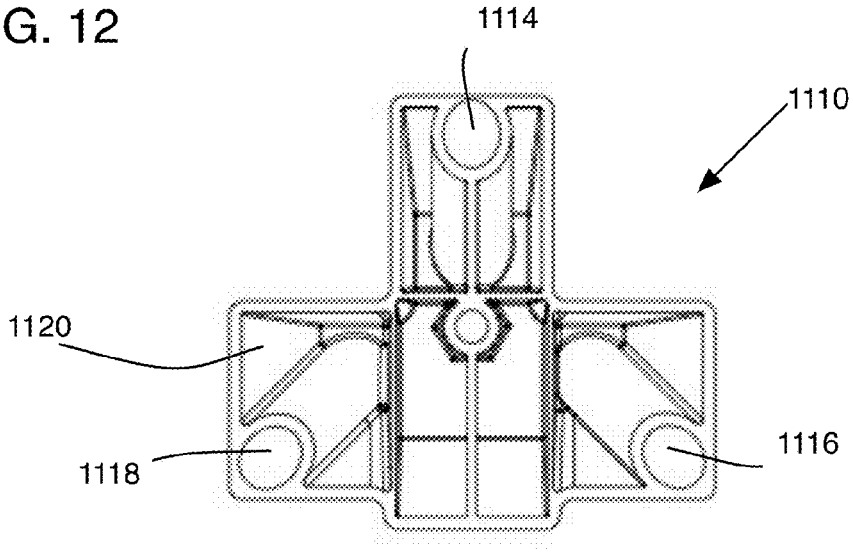

FIG. 12 is a bottom view of the embodiment of FIG. 11.

Figure 13:
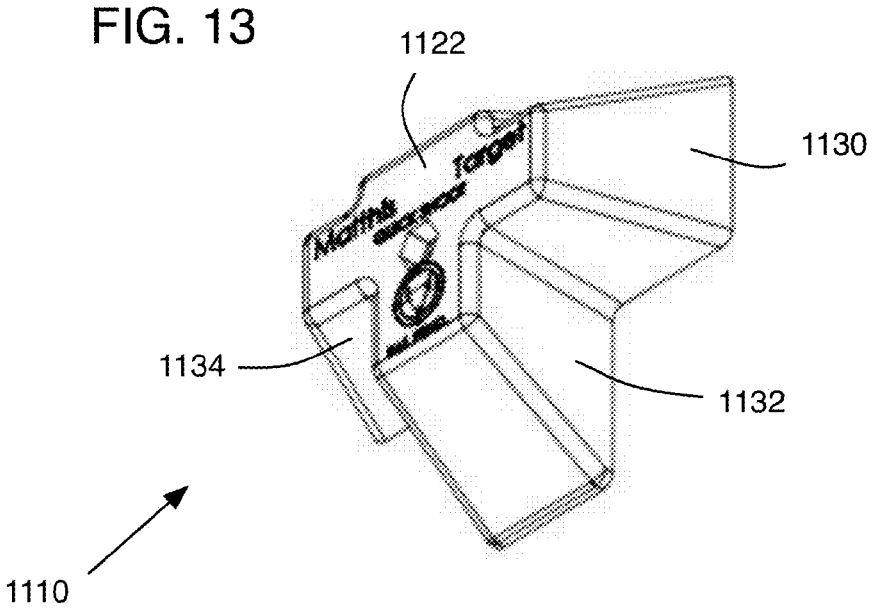

FIG. 13 is an offset frontal view of the embodiment of FIG. 11.

Figure 14:
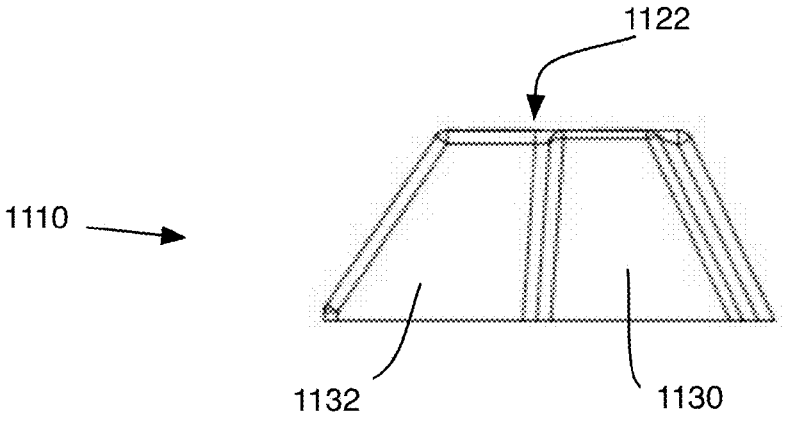

FIG. 14 is a side view of the embodiment of FIG. 11.

Figure 15:
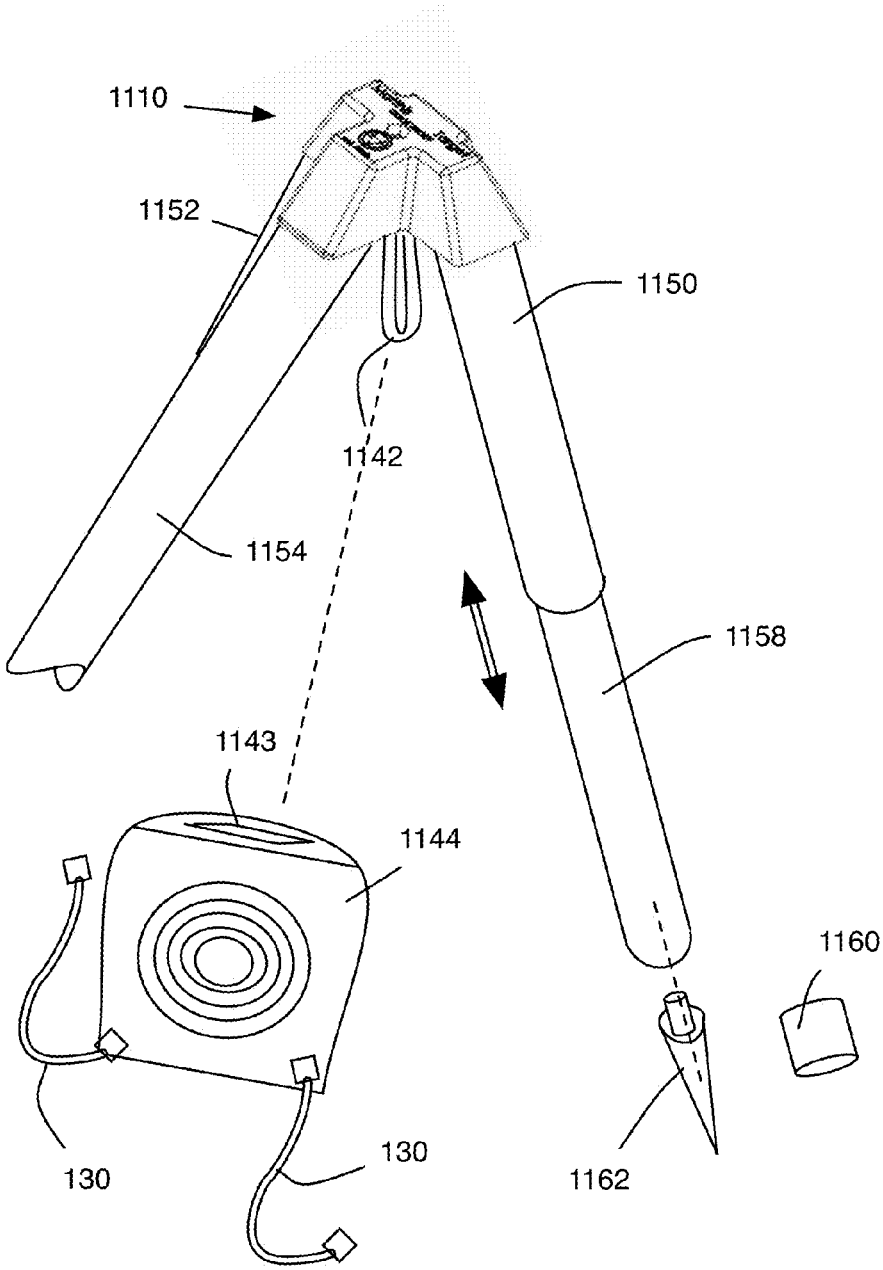

FIG. 15 is an offset frontal view of the embodiment of FIG. 11 and includes adjustable support legs having interchangeable end-pieces.

DESCRIPTION OF THE INVENTION

Possible preferred embodiments will now be described with reference to the drawings and those skilled in the art will understand that alternative configurations and combinations of components may be substituted without subtracting from the invention. Also, in some figures certain components are omitted to more clearly illustrate the invention.

One embodiment of the present invention, developed from an early prototype embodiment of the archery target mount, comprises the T-shaped split flange design shown in FIG. 2, but the target legs can be secured to the mount by additional methods, including those listed below. Suitable configurations of the mounting block include a T-shaped design and a two-piece round shape. Variations on support leg securing mechanisms include embodiments for securing the support legs via the mounting block and embodiments where the support legs themselves provide the means of securing to the mounting lock.

In the embodiments described herein, the material for mount 100 may be a HDPE-like material, but polycarbonate or wood mounts are also functional as is aluminum or other durable and lightweight materials. The mounting block should be made of a strong, tough, resilient material that is easy to clean, and preferably one that can be colored as desired (for example, in camouflage or high-visibility colors). A preferable overall thickness of mounting block is ½-inch. Unlike typical tripod structures, the target mount is fixed and not capable of rotating and tilting. Three removable legs 121, 122, 123 provide for ease of transport and adjustment when setting up the target stand. Preferable leg materials include those that are durable, yet easily replaceable in the event of damage, such as standard sized wood dowels or aluminum tubing. Preferable leg diameter is ⅜-inch, but could be as large as 1 and ⅛-inch.

A preferable method of securing target 110 to the mounting block includes hanging the target by its handle to eyebolt 420 that is secured to the bottom of the mounting block through opening 340.

Embodiments for securing the legs to the assembly via the mount include a split flange design, tapered insert, finger joint insert, two-piece mount assembly, and set screw securing mechanism.

FIG. 2 shows the mount 100 in a T-shaped design with split flanges to secure the legs. The mounting block 210 is split by removing material from the outside edge to leg holes 221, 222, 223. Preferable hole diameters 221,222 and 223 include about a ⅜-inch to 1⅛-inch, according to the corresponding leg diameter. Legs are secured by tightening the mount against the leg with through bolt 230. A wing nut 240 permits tool-less adjustment of the legs.

FIG. 5 details a tapered hole to accept the leg. A variation in leg hole diameter between the top and bottom of the target mount 500 allow leg 510 to become secured as it is inserted through the top of the mount and contacts the mount at the smaller diameter 520. The legs may be removed by pushing them all the way through the hole. This method of securing can be used for the Tshaped and circular shaped mounts, as well as embodiments of other shapes.

FIG. 6 details the finger joint method of leg securing. The hole is constructed with finger joint 620 to provide a friction fit for leg 610 as it is inserted through the top of the mount. The size and shape of the finger joint varies according to mount and leg material. This method of securing can be used for both the T-shaped and circular shaped mounts.

FIGS. 9 and 10 show a two-piece, circular mount assembly. Mount plates 1010 and 1020 have corresponding holes 1050 that allow for leg insertion. The legs are secured by turning one plate 1010 relative to the other plate 1020, wedging the legs in place. The turned mount acts as a chock against legs 921, 922, and 923 when it is turned until it cannot move. The two mount plates can then secure in position by a through-bolt that tightens the two plates 1010 and 1020 to each other. A wing nut provides a preferable method of tightening.

The mount can also provide leg securing with the addition of a setscrew or bolt that protrudes through the mount flange into the leg opening. Unscrewing the bolt allows for leg installation; once the desired leg position is achieved, the bolt can be turned until it just contacts the support leg and prohibits movement. Preferred setscrews include thumbscrews that are easy to turn with one hand and ideal for parts that are frequently removed. This method of securing is a useful alternative for the T-shaped mount.

Embodiments for assembling the legs to the mount via the legs include: finger joint or spiral groove finish on support leg, a high friction finish on the support legs and hose clamp securing mechanism.

FIG. 7 shows a finger joint or spiral groove support leg 710 that provides a friction fit for the leg as it is inserted through the top of the mount and contacts the mount hole. The size and shape of the support leg texture 720 varies according to mount and leg material. A preferable shape for the support leg finish is a spiral groove.

FIG. 8 details a friction fit where a leg has a high friction finish 810, securing the leg as it is inserted through the mount hole. Preferable finishes include: lacquer, shellac and epoxy.

The archery target can also be assembled by installing spring clips (e.g., hose clamps) to the support legs on at least one side of the target mount holes. The clamps will provide a semi-rigid method of leg securing that is capable of providing some movement to the legs as the clamp is moved away from the mount leg opening. Preferred clamps include rotor clamps, which do not require tools for installation or adjustment.

Leg position and angle vary among the embodiments. FIGS. 3 and 4 show plan and front details of T-shaped mount 300. Leg holes 321, 322 and 323 are angled to provide target support without obstructing the target during shooting. Preferable angles 410 vary from 30° to 45°. Additionally, the centerlines of holes 321 and 322 may be offset (see 330) from each other so that legs 321*a* and the leg that would be inserted in hole 322 (leg not shown) do not interfere with each other on the top of the mount once assembled. Unlike a standard tripod, the angle of the legs need not be adjustable, and the legs need not telescope (telescoping legs may be heavier, more expensive and more prone to damage). In embodiments of the invention, the angled holes allow for leg adjustment by moving the legs either up or down through the mounting block.

This method of adjustment allows the target mount to be set up at a location where the ground is uneven, and allows for removal of the legs for ease of transport. Additionally, unlike tripods which have legs that are equidistant from one another (e.g., arranged at 120° for a three-legged tripod), legs 321*a* and the opposing leg in hole 322 (leg not shown) are at about 180° (see reference character 310), while leg 321*a* is positioned at about 90° to leg 323*a*. Preferable hole diameters for 321, 322, and 323 varies from ⅜" to 1⅛", according to the leg size to be used.

FIGS. 9 and 10 show a two piece mount assembly that secures the legs by acting as a chock when the at least three legs are inserted through the mount plate holes (see line 1050) and then one of the mount plates (1010 or 1020) is twisted relative to the other until it tightens against the legs. Mount plates 1010 and 1020 may have multiple holes at various angles to adapt the target mount to uneven terrain. For example, in this figure, holes 1030 are at angles of 45°, while holes 1040 are at angles of 30° (from the horizontal). The variation in leg angle and position allows for optimal setup of the target support based on terrain and needed accessibility to the target.

It is preferred that the mechanism for suspending the target from the mount block (e.g., eye bolt 420 in FIG. 4) be loosely or non-rigidly mounted to the block. For example, hole 340 (FIG. 3) may be oversized with respect to the shank of eyebolt 420. Having a small amount of "play" or "give" in this part of the mount allows the target to move slightly when struck with an arrow. Even slight movement can dissipate some of the arrow's energy, which reduces the energy to be dissipated by the target block material and prolongs the useful life of the target block. In addition, as shown in FIG. 1 at 130, it is preferred to have stabilizing shock cords to help resist target swinging and spinning. Again, shock cords 130 do not hold the target rigidly in place, but allow it to move in response to an arrow strike; but nonetheless return the target to its rest position quickly in preparation for the next shot.

The applications of the present invention have been described largely by reference to specific examples and in terms of particular physical structures. However, those of skill in the art will recognize that portable target supports can also be constructed in different forms without departing from the principles of the present invention.

FIGS. 11-15 illustrate a second preferred embodiment of the present invention. Accordingly a target mount 1110 consists of a smaller T-shaped mount body 1112 having three mount holes 1114, 1116, and 1118. Each respective mount holes terminates at a solid wall portion 1120 provided by an underside of a top surface 1122 of the mount body 1112.

With specific reference to FIG. 15, a second preferred embodiment of the present invention includes a system having a target mount 1110 as just described and the target mount includes three legs at least one of which is adjustable along its length to provide for greater stability of the target mount on uneven terrain. The target mount accepts legs 1152 and 1154 and 1150. Any of the legs or all of the legs can include a mechanism for adjusting the length of the leg. Thus, leg 1150 includes an adjustable portion 1158 that slides in and out relative to the upper portion. An adjustment mechanism for telescoping members (such as ski poles, camera tripods and the like) are well understood and any of these mechanisms would work well in the present embodiment. The legs may also include distal terminus protection devices such as a rubber foot 1160 for hard surface and a pointed tip 1162 for softer surfaces.

The legs 1150, 1152, and 1153 slideably insert into corresponding mount holes 1114, 1116, and 1118. These legs can be friction fit into the holes, thus requiring no tools. Alternatively the legs can include a locking feature with a corresponding modification to the target block, such as a rotating pin and groove, or other coupling means such as fasteners can be used to more securely attach the legs to the target mount. Those having ordinary skill in this art will understand a myriad of possible mechanisms to provide quick-release disassembly of the legs from the mount yet provide secure coupling of the legs to the mount when assembled. All such iterations are contemplated.

Additionally, the target mount includes a mechanism 420 for suspending the target from the mount block. This mechanism can be an eyebolt as previously discussed, or some other rigid hanging mechanism as would be understood in the art. However, if a rigid mechanism is used, it should ideally be loosely or non-rigidly mounted to the block. For example, the attachment point for this mechanism (not shown in this figure) can be oversized with respect to the shank of the hanging mechanism thus providing a small amount of "play" or "give" in this part of the mount allows the target to move slightly when struck with an arrow. Alternatively, the hanging mechanism can be a deformable member 1142 such as a loop of shock cord suspended from the target mount and adapted to couple to the target at a feature 1143 adapted for such use, such as a handle or eyelet. Further, although the figure illustrates only three mounting points for the target 1144, additional mounting points can be included to increase target stability when mounted to the target mount 1110.

Because even slight movement can dissipate some of the arrow's energy, which reduces the energy to be dissipated by the target block material and prolongs the useful life of the target block, one or more stabilizing shock cords 130 selectively couple to the target 1144 and the target mount or legs to help resist target swinging and spinning. Again, shock cords 130 do not hold the target rigidly in place, but allow it to move in response to an arrow strike; but nonetheless return the target to its rest position quickly in preparation for the next shot.

One particularly well-suited material contemplated for various preferred embodiments of the present invention include 8018 Nylon. The relative angle of the three mount holes, independently measured from a horizontal plane are about 114.51-degrees.

Although the invention has been particularly shown and described with reference to certain embodiments, it will be understood by those skilled in the art that various changes in form and detail may be made without departing from the spirit and scope of the invention.

I claim:

1. A system for selectively coupling to a shooting target, the system comprising:

a target mount device comprising a T-shaped support block having three mount holes formed near each terminal end of its shape, axes of said mount holes approaching one another above a plane of the support block and diverging from one another below the plane of the support block and wherein each mount hole terminates at a solid wall portion provided by an underside of a top surface of the mount body;

the target mount device further comprising three legs adapted to be inserted into the three mount holes wherein the at least one support leg further comprises an adjustment mechanism for extending a length of the support leg;

a target support loosely connected to the support block, the target support disposed below the plane of the support block; and at least two stabilizing shock cords configured to connect to two bottom corners of the shooting target, the shock cords further configured to couple to the target mount device at at least a lower end of the at least one support leg whereby the shock cords are configured to deter the shooting target from swinging and rotating excessively after a projectile strikes the shooting target.

2. The system of claim 1 wherein:

any one or more of the three support legs further comprises a corresponding foot selectively coupled to a distal end of the support leg.

3. The system of claim 2 wherein:

the corresponding foot comprises a rubber terminus.

4. The system of claim 2 wherein:

the foot comprises a pointed tip.

5. The system of claim 1 wherein each of the three support legs, respectively, further comprises:

an adjustment mechanism for extending the length of the leg.

* * * * *